United States Patent [19]

Parker et al.

[11] Patent Number: 4,606,468

[45] Date of Patent: Aug. 19, 1986

[54] ATTACHMENT FOR DISPLAY SHELVES

[76] Inventors: Tracy A. Parker, 300 W. 10th St.; Ted L. Fronk, 928 W. Main St., both of St. Anthony, Id. 83445

[21] Appl. No.: 689,090

[22] Filed: Jan. 4, 1985

[51] Int. Cl.[4] ..... A47F 7/00

[52] U.S. Cl. ..... 211/184; 108/61; 211/43; 211/49.1

[58] Field of Search ..... 211/42, 43, 184, 49.1, 211/50, DIG. 1, 59.3; 108/60, 61

[56] References Cited

U.S. PATENT DOCUMENTS

| | | | |
|---|---|---|---|
| 774,984 | 11/1904 | Green | 211/43 |
| 2,013,085 | 9/1935 | Anderl | 211/49.1 |
| 2,345,228 | 3/1944 | Babineau | 211/45 |
| 2,946,455 | 7/1960 | Meyers | 211/49.1 |
| 3,120,894 | 2/1964 | Conley | 211/43 |
| 3,974,918 | 8/1976 | Yaremchuk | 211/DIG. 1 |
| 4,341,314 | 7/1982 | Feuerstein | 211/184 |
| 4,494,659 | 1/1985 | Spees | 211/DIG. 1 X |

*Primary Examiner*—Robert W. Gibson, Jr.
*Attorney, Agent, or Firm*—Harvey B. Jacobson

[57] ABSTRACT

Wedge-shaped shelf attachments are located on a shelf of a display case to provide a support surface against which a row of products, such as frozen food boxes, can be stacked. The attachments are located on the shelf so as to display the products at the front of the shelf thereby providing the appearance of a filled shelf.

7 Claims, 5 Drawing Figures

ATTACHMENT FOR DISPLAY SHELVES

BACKGROUND OF THE INVENTION

This invention relates to attachments for display shelving, such as shelving in supermarket freezer cases and the like, for improving the display of merchandise thereon. More particularly, the attachments allow merchandise to be displayed at the front of a shelf in a display case or the like, giving the case a full and attractive appearance, even if the shelf is not filled with the merchandise.

STATEMENT OF PRIOR ART

Applicants are aware of the following U.S. patents, the relevance of which is that they disclose article surrports for use in displaying food products and the like. None of the patents, however, discloses shelf attachments having the features of the present invention: U.S. Pat. Nos. 1,609,945; 1,659,509; 2,886,182; 2,946,455; 3,200,957.

SUMMARY OF THE INVENTION

The invention provides a shelf attachment for use in combination with a shelf in a merchandise display case or the like, comprising a substantially planar wedge-shaped element having securement means on one edge thereof for releasably securing the element in selected location and a shelf in a manner whereby another edge of the element provides a vertically extending support surface against which a row of products, such as frozen food boxes or the like can be stacked. If, for example, there are insufficient products available to fill the complete width of a shelf, the attachment can be secured between the front and rear edges of the shelf in a position whereby the available number of products are sufficient to form a row extending from the attachment to the front of the shelf. Also, as products are successively taken from the front of the shelf, so that the length of a product row decreases, the attachment can be moved progressively forwards on the shelf to accommodate this. Attachments in accordance with the invention may be used in pairs for supporting a single row of products, and lines of attachments may be used on a shelf for adjacent product rows.

Preferably, the attachments are made of wood to inhibit the buildup of ice thereon. For wire-type shelves, the securement means may conveniently comprise orientable hooks, such as screw hooks, which can be looped around the rods of a shelf, and for flat metal shelves, the securement means may comprise permanent magnets. The attachments may be supplied in different sizes and may be secured on a shelf in different configurations depending on the type of product and the display required.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENTS

Referring initially to FIGS. 1 to 4, there is illustrated a shelf attachment in the form of a wedge-shaped wooden block 10 having a base edge 12, a perpendicular edge 14, and an inclined edge 16. The block may be about two inches thick, about six inches high, and about three inches along the base. However, blocks of different height, for example about ten inches or three inches in height may also be provided for different applications.

Figure 2:
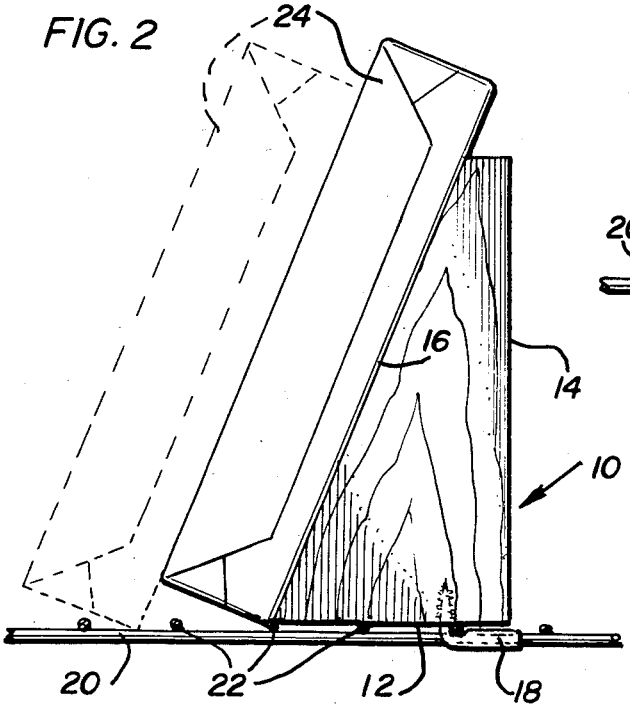
FIG. 2 is an elevational view of the attachment secured on a display case shelf in a first orientation.

The illustrated block 10 further includes a pair of screw-type hooks 18 on the base edge 12 for releasably securing the block on a display shelf 20 formed with lengthwise wire rods 22 or the like. In this connection, hooks 18 may be hooked under the rods in a required location on the shelf so as to present the inclined edge 16 of the block toward the front of the shelf to form a support surface for a stacked row of products such as frozen food boxes 24, as shown in FIG. 2. Conveniently, the location of the attachment may be selected such that the forwardmost box 24 is presented at the front of a shelf. Attachments in accordance with the invention may be used in pairs for each stacked row of products, and the attachments may be readily unhooked, pushed forward along the shelf, and hooked into the next rods 22 as the product row is used up, so as to keep presenting the products at the front of the shelf.

Figure 1:
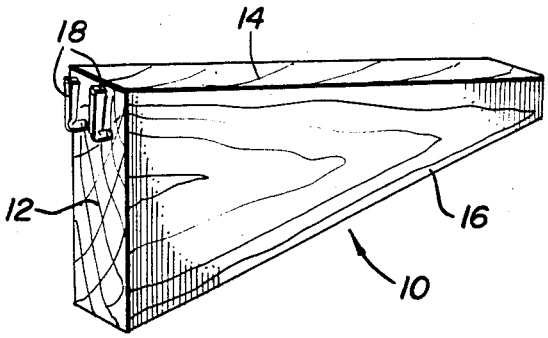
FIG. 1 is a perspective view of a shelf attachment in accordance with the invention.
Figure 5:
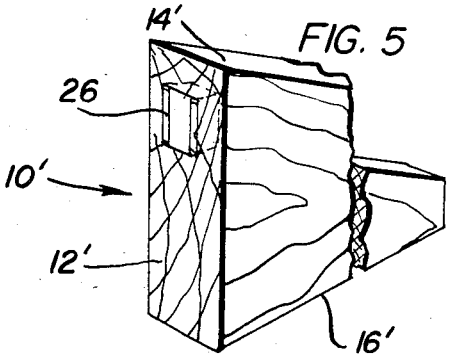
FIG. 5 is a perspective view, part broken away, of a modified form of shelf attachment in accordance with the invention.
Figure 3:
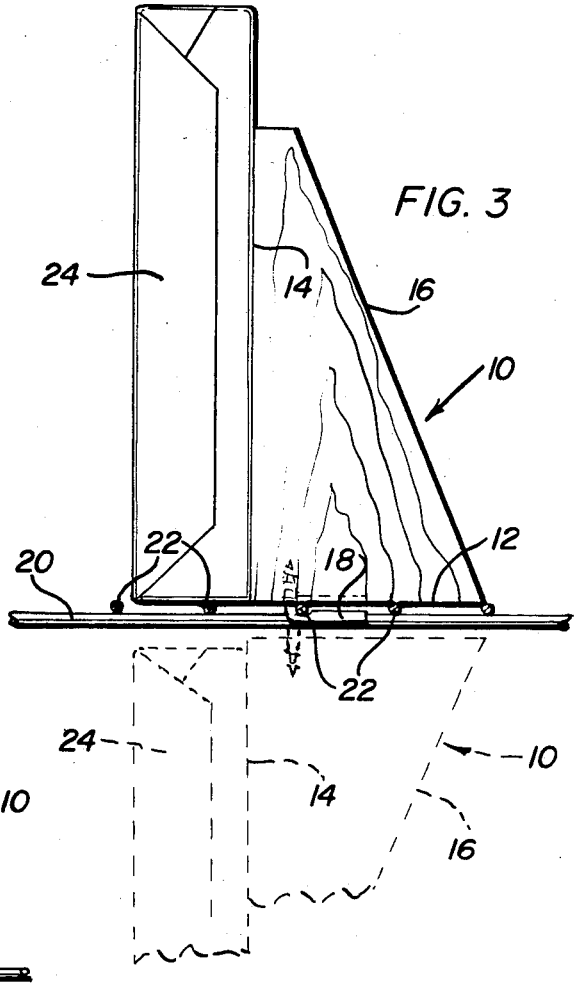
FIGS. 3 and 4 are views similar to FIG. 2 showing alternative arrangements of the attachment in connection with a display case shelf.
Figure 4:
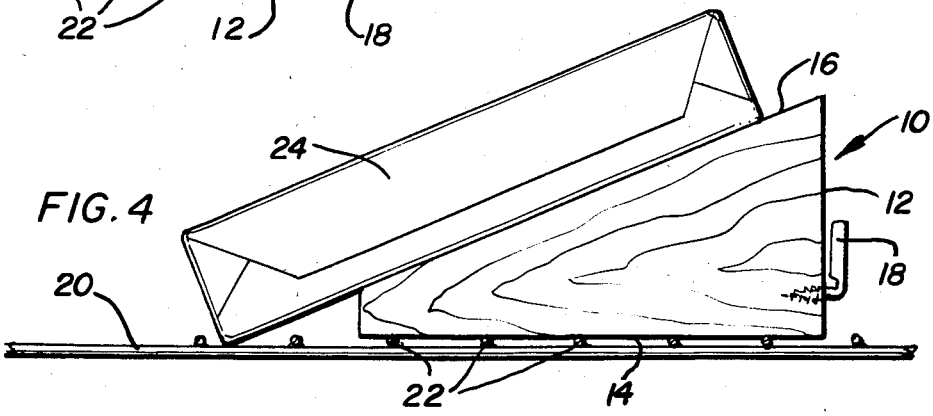

By swinging the hooks through 180°, perpendicular edge 14 of the block can be used as the product support edge, as shown in FIG. 3, and as also shown in this figure in phantom, the attachments can be suspended from a shelf above to form a support surface for products on a shelf below. The attachments may also be suspended so as to present edge 16 as the support edge. FIG. 4 shows the use of attachment 10 with edge 14 flat on a shelf for the shallow stacking of a row of products. The attachment 10' shown in FIG. 5 is similar to attachment 10 except that hooks 18 are replaced by a permanent magnet 26 embedded in the attachment, for use of the attachment on flat metal shelving in similar manner to the previous embodiment.

It will be appreciated from the foregoing that the invention provides a useful means for improving the appearance of products on display shelving which allows a display case or the like to have a full and attractive appearance with products displayed at the front of the shelving, while allowing a storekeeper to control inventory. The shelf attachments can give a more professional look to a display shelf, allow for a reduction in stocked inventory, thus improving cash flow, and lower the degree of out-of-date spoilt merchandise which is rejected.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An attachment for use in combination with a merchandise display shelf having spaced wire rods extending lengthwise the shelf, the attachment comprising a generally planar wedge-shaped element having securement means along one edge thereof for releasably securing the element in selected location on a shelf in a manner whereby another edge of the element provides a support surface against which a row of products can be stacked whereby a forwardmost one of the products may be displayed at the front of the shelving wherein the securement means comprises a pair of rotatable screw-in hooks for engaging a selected rod of a shelf, the rotatable hooks enabling either one of the other edges of the element to be presented toward the front of the shelf.

2. The invention of claim 1 wherein the wedge-shaped element comprises a base edge provided with the securement means, and a perpendicular edge and inclined edge longer than the base edge.

3. The invention of claim 2 wherein the wedge-shaped element is made of wood.

4. In combination with display shelving for food products which includes a shelf formed of spaced longitudinal wire rods, a shelf attachment positioned at a selected location on the shelf providing a support surface for leaning a row of products against so as to enable a forwardmost product of the row to be displayed at the front of the shelving wherein the attachment comprises a wedge-shaped element having a base edge and a perpendicular edge and an inclined edge each longer than the base edge, the attachment further including securement means on the base edge releasably securing the attachment to the shelf with the base edge engaging said wires and one of the inclined edge and perpendicular edge presented to the front of the shelf.

5. The invention of claim 4 wherein the attachment extends upwardly from the shelf and the products are stacked on the shelf.

6. The invention of claim 4 wherein the attachment extends downwardly from the shelf for supporting products on another shelf therebelow.

7. The invention of claim 4 wherein the shelving is the shelving of a freezer display case and the attachment is made of wood.

* * * * *